US005172080A

United States Patent [19]

Fisher et al.

[11] Patent Number: 5,172,080

[45] Date of Patent: Dec. 15, 1992

[54] GARNET CENTERING RING FOR CIRCULATORS AND ISOLATORS

[75] Inventors: David S. Fisher, Freehold, N.J.; Warren H. Gustafson, Falls Church, Va.

[73] Assignee: Radio Frequency Systems, Inc., Marlboro, N.J.

[21] Appl. No.: 722,336

[22] Filed: Jun. 28, 1991

[51] Int. Cl.[5] ..... H01P 1/387

[52] U.S. Cl. ..... 333/1.1; 333/24.2

[58] Field of Search ..... 333/1.1, 24.1, 24.2

[56] References Cited

U.S. PATENT DOCUMENTS

| | | | |
|---|---|---|---|
| 3,414,843 | 12/1968 | Jansen | 333/1.1 |
| 4,145,672 | 3/1979 | Piotrowski | 333/1.1 |
| 4,276,522 | 6/1981 | Coerver | 333/1.1 |
| 4,749,965 | 6/1988 | Prevot et al. | 333/1.1 |

FOREIGN PATENT DOCUMENTS

| | | | |
|---|---|---|---|
| 2246114 | 4/1975 | France | 333/1.1 |
| 2-11702 | 8/1990 | Japan | 333/1.1 |

*Primary Examiner*—Paul Gensler

*Attorney, Agent, or Firm*—Ware, Fressola, Van Der Sluys & Adolphson

[57] ABSTRACT

In a circulator/isolator device used in a cellular transmission network, a centering ring is used to position the garnets with respect to the center conductor, magnets and pole piece. The clamping action of the housing holds the unit together. Because the ring centers all components, additional fixtures are not needed and inaccurate "eyeballing" by the assembler is eliminated. The garnets are held in place during assembly by the centering ring thereby eliminating the need for adhesive or dielectric grease.

25 Claims, 3 Drawing Sheets

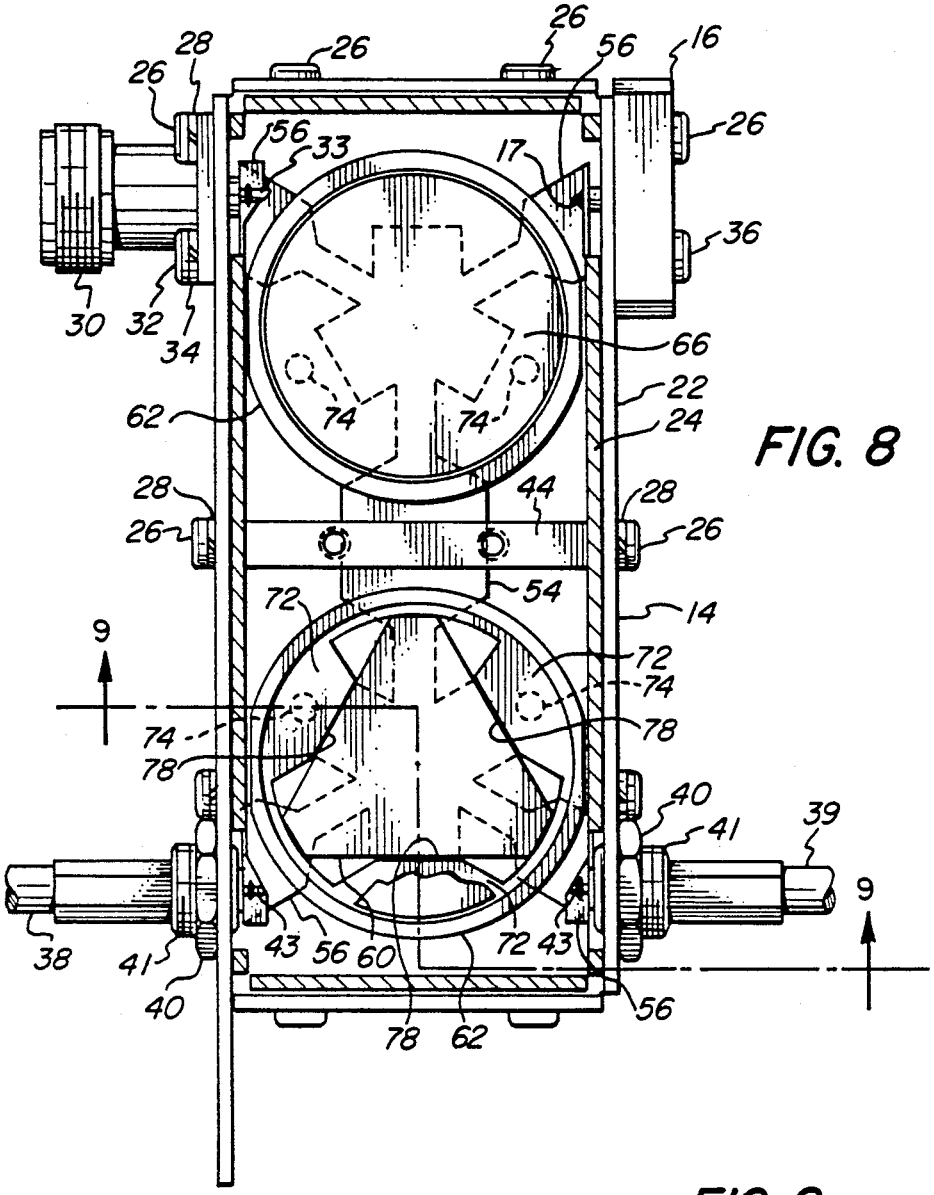
FIG. 8
FIG. 9
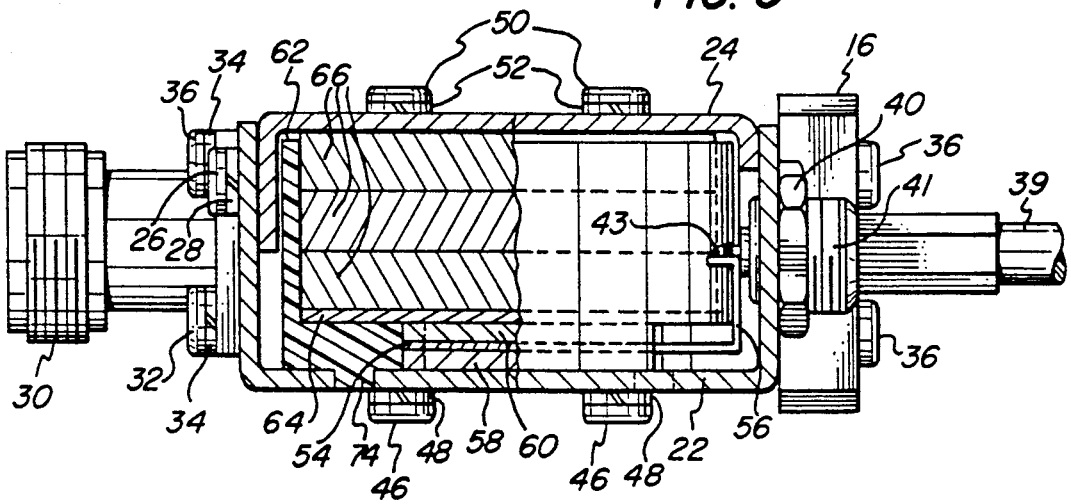

GARNET CENTERING RING FOR CIRCULATORS AND ISOLATORS0

BACKGROUND OF THE INVENTION

1. Field of the Invention

The present invention relates to cellular telephone signal transmission and more particularly to circulators and isolators used in the transmission of high-frequency signals such as cellular telephone signals.

2. Description of the Prior Art

Cellular telephone service is becoming exceedingly popular and is very much in demand. Cellular telephones operate in a frequency band considerably higher than the normal AM/FM radio and use circulator-/isolator devices for preventing intermodulation and appropriately directing the signal in the transmitting circuit. A circulator is an isolator without a load attached thereto.

In the assembly of circulator/isolator devices, the garnet(s), center conductor, pole piece and magnets have been held together by four different methods. The first method has the magnets and pole piece held together by a wrap of a copper or similar material or with a separate magnet casing, and the garnet or garnets held to the center conductor with an adhesive. In the second method, the magnets are held together as in the first method but the garnet or garnets are held to the center conductor with a dielectric grease. The third method employs adhesive to hold together the magnets, pole piece, garnet or garnets and center conductor. The fourth method includes all aforementioned components being held together with a dielectric grease. In all four methods, a clamp, whether it be a separate clamp or the housing, is utilized to hold the assembly together under pressure. Such pressure can crack the brittle garnets.

In all of the four above mentioned methods, there is a compound, whether it be adhesive or dielectric grease, which is between the center conductor and garnet or garnets. This compound increases the insertion loss of the circulator/isolator device. Also, during the assembly process, added labor is needed to apply the compounds to the components thereby increasing the cost of the device. In each of the methods, either an extra fixture must be provided to center all of the components with respect to each other or, as in most cases, the centering is "eyeballed" by the person assembling the device. Improper centering tends to decrease the performance of the device.

SUMMARY OF THE INVENTION

The present invention is designed to overcome the above noted limitations that are attendant in the "prior art" and toward this end it contemplates the provision of a novel centering ring which will hold the garnets of the circulator/isolator in a centered relationship with respect to the center conductor, magnets and pole piece.

An object of this invention is to hold the components in assembly without the need for adhesive or dielectric grease.

Another object is to provide a circulator/isolator device which can be assembled without the need of additional fixtures or "eyeballing" by the assembler.

Still another object is to provide such a circulator-/isolator device which may be readily and economically fabricated and will enjoy a long life and operation.

It has now been found that the foregoing and related objects can be readily attained in a device for directing radio frequencies comprising a housing forming an enclosure with at least two radio frequency transmission lines extending into the enclosure of the housing. A central conductor is located within the enclosure to electrically connect the lines with one another.

At least one garnet is also located within the enclosure adjacent a portion of the central conductor. A magnetic field source within the enclosure provides a magnetic field around the at least one garnet and the central conductor. A positioning device is used for centering the magnetic field source relative to the at least one garnet and the center conductor. The positioning device includes a main body portion for retaining the magnetic field source and a plurality of land portions on the main body portion dimensionally sized to position the at least one garnet and the center conductor relative to the magnetic field source.

Desirably, the main body portion is in the form of an annulus dimensionally sized to receive said magnetic field source therewithin. The land portions extend radially inwardly from one end of the main body portion. The land portions have inwardly facing abutment surfaces which align with sides of the at least one garnet to position the same relative to the magnetic field source. The land portions are dimensionally sized to provide a seat for the magnetic field source within the main body portion.

Ideally, the at least one garnet is two garnets which sandwich a portion of the central conductor therebetween. The two garnets and the sandwiched portion of the central conductor are positioned between the abutment surfaces of the land portions while the magnetic field source abuts one of the garnets.

In the preferred embodiment, the magnetic field source includes a magnet and a pole piece for providing a uniform magnetic field around the at least one garnet and the central conductor. The pole piece abuts the at least one garnet.

The invention will be fully understood when reference is made to the following detailed description taken in conjunction with the accompanying drawings.

BRIEF DESCRIPTION OF THE DRAWINGS

FIG. 8 is a top plan view of the isolator device with its cover broken away and some components removed to show internal structure.

FIG. 9 is a cross-sectional view of the isolator device taken along the 9—9 line of FIG. 8.

DETAILED DESCRIPTION OF THE PREFERRED EMBODIMENT

Figures 1, 2:
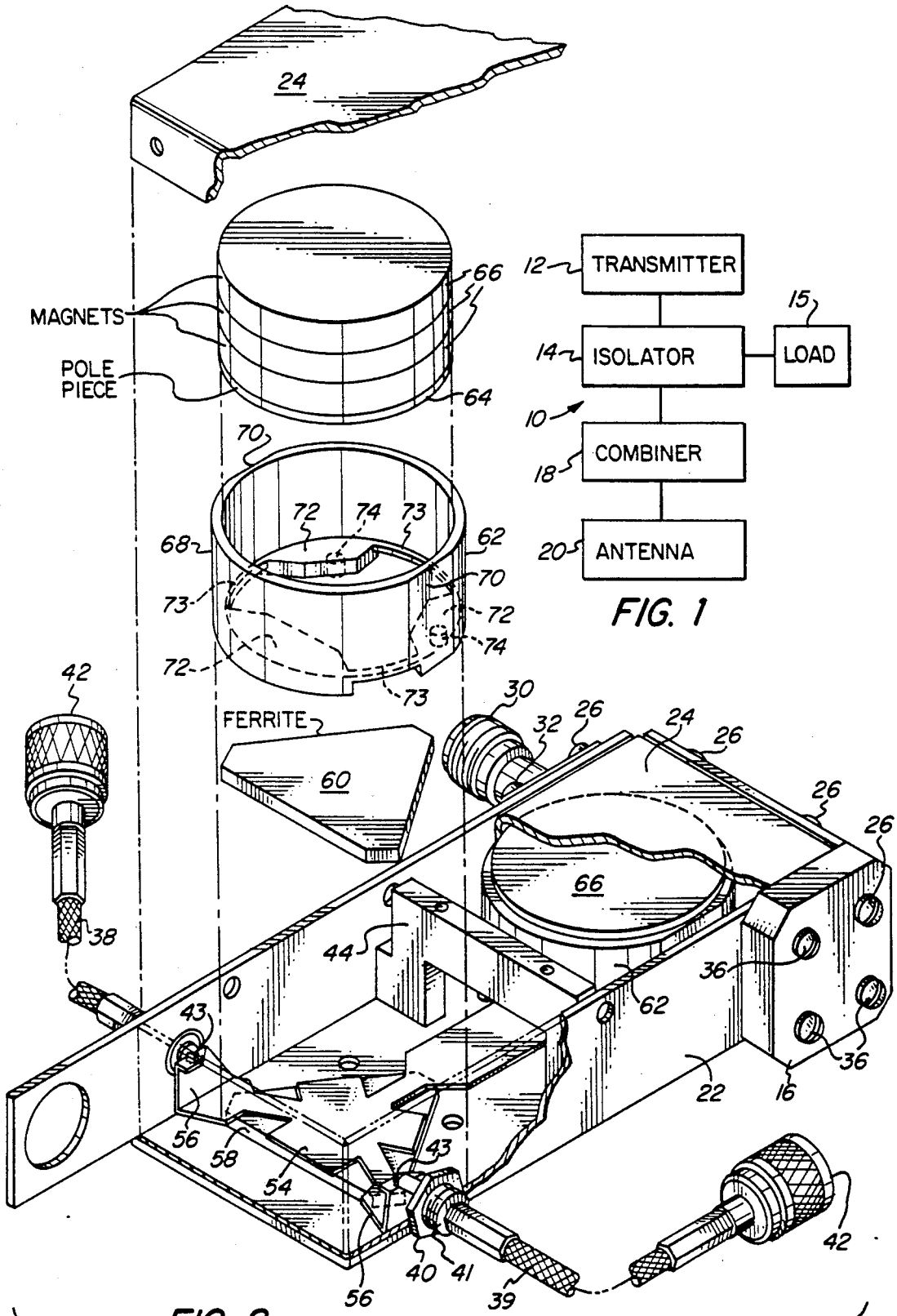
FIG. 1 is a schematic block diagram of a cellular transmitting network circuit using an isolator device of the present invention.
FIG. 2 is a partially exploded perspective view of an isolator device employing the present invention.
Figure 3:
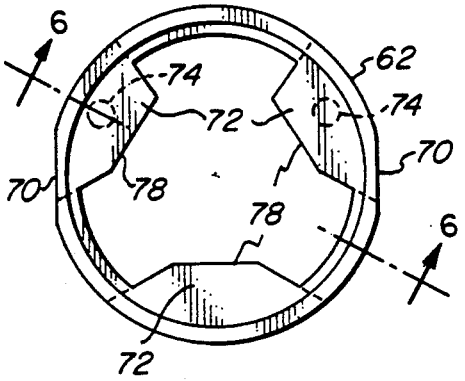
FIG. 3 is a top plan view of the centering ring of the present invention.
Figure 4:
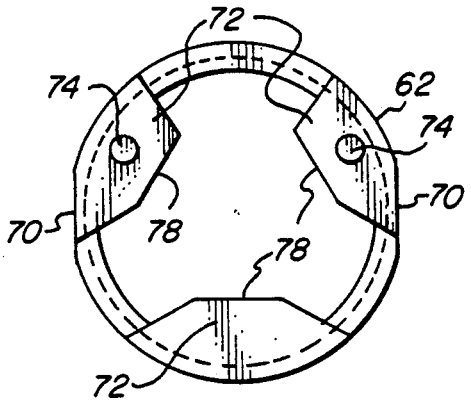
FIG. 4 is a bottom plan view of the centering ring of the present invention.
Figure 6:
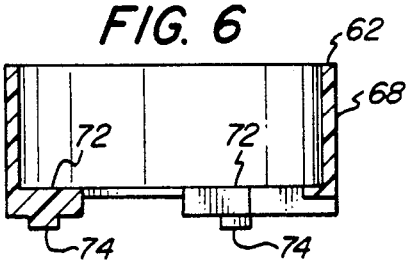
FIG. 6 is a cross-sectional view of the centering ring taken along the 6—6 line of FIG. 3.
Figure 5:
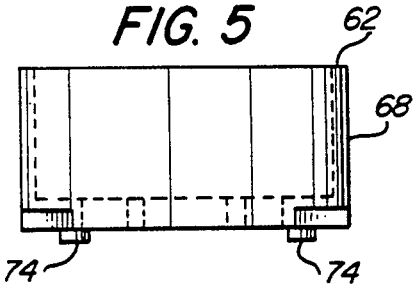
FIG. 5 is a side elevational view of the centering ring.
Figure 7:
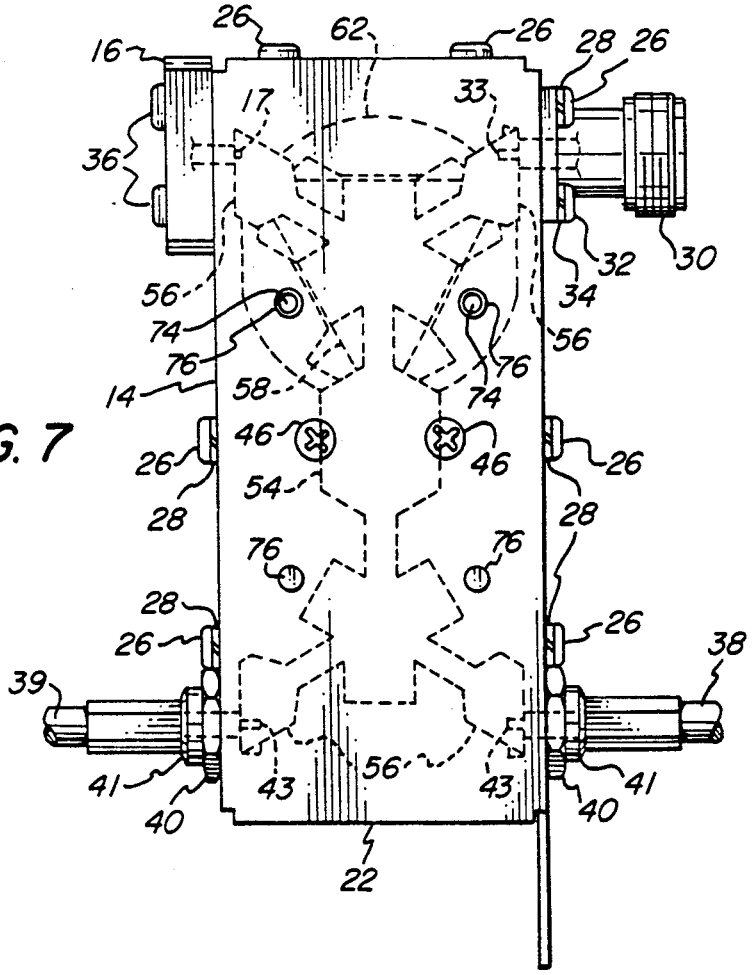
FIG. 7 is a bottom plan view of an isolator device of the present invention with some of the internal components shown in dotted line.

Turning first to FIG. 1, therein is illustrated a typical cellular transmitter network generally indicated by the numeral 10. The network 10 has a transmitter 12 connected to an isolator device 14 of the present invention. The isolator device 14 is connected to a high power load 15 (60 watts, 50 ohms). The load 15 is a protection device which will dissipate the transmitted power in the event of a malfunction in the network 10 after the isolator device 14. The isolator device 14 is connected to the transmitter 12 and is provided with a combiner 18, between it and an antenna 20, to allow other transmitters to be connected to the same antenna.

The isolator device 14 is shown in greater detail in FIGS. 2 and 7–9 and is of the dual stage variety. The isolator device 14 is comprised of an elongated rectangular metal housing 22 having a cover 24 secured thereto by a plurality of screws 26, some of which use lock washers 28. The screws 26 extend through the cover 24 and are threadingly received in the housing 22. Mounted on opposed side walls at one end of the housing 22 are a female Type N connector 30 which is used for connection to the transmitter 12 and a second load 16 which is in the form of a ceramic resistor (15 watt, 50 ohms) shorted to a large block which operates as a heat sink. The second load 16 functions as back up protection to dissipate power missed by the load 15. The load 16 is chosen to be compatible with the isolator device 14 so as to make the isolator device 14 compatible for a specific power rating. The load 16 is held by three screws 36 threadingly received in the housing 22 in conjunction with one of the screws 26. In turn, the female Type N connector 30 is held to the housing 22 by three screws 32 and lock washers 34 in addition to one of the screws 26 which extends through the housing 22 and into the cover 24. The female Type N connector 30 also has an internal -terminal pin 33.

Threadingly received in the opposed side walls at the other end of the housing 22 are opposed transmission cables 38 and 39. Cable 38 connects to the combiner 18 while cable 39 connects to the high power load 15. Nuts 40 are received on threaded ends 41 of the cables 38,39 to secure them to the housing 22. Each cable 38,39 has a male Type N connector 42 at the end thereof for connecting the cables 38,39 to the transmitter 12 and combiner 18. The other ends of the cables 38,39 are provided with internal terminal pins 43.

Separating the housing 22 into two internal sections is a center dividing arch 44 held in assembly with the housing 22 by two screws 46 and lock washers 48 (FIG. 9). Two additional screws 50, with lock washers 52, extend through the cover 24 and threadingly engage the center dividing arch 44. The center dividing arch 44 is made of nickel plated cold roll steel to separate and magnetically isolate the output stage of the isolator device 14 from the input stage.

A center conductor 54 made from 0.005" thick brass is located within the housing 22 with four extending arms 56 soldered to the internal terminal pins 17, 33 and 43 of the load 16, female Type N connector 30 and male Type N connectors 42, respectively. The center conductor 54 extends through the archway formed by the center dividing arch 44.

On each side of the center dividing arch 44 is a stacked assembly of triangular-shaped ferrite garnets 58,60, annular centering ring 62, disc-shaped pole piece 64 and three disc-shaped magnets 66. The centering ring 62 is injection molded from a plastic resin such as polypropylene and can be best seen in FIGS. 3 through 6. To hold tight dimensions in the centering ring 62, a blowing agent material is added to the polypropylene during the injection molding process. The centering ring 62 has a main annular body portion 68 having two opposed flat areas 70 so the centering ring 62 properly indexes within the confines of the housing 22 and the cover 24.

The lower end of the main annular body portion 68 has three inwardly extending land portions 72 having a thickness approximately equal to the combined thicknesses of the two garnets 58,60 and the center conductor 54. Connecting the land portions are smaller bridge portions 73. Two of the land portions 72 have protruding pin elements 74 dimensionally sized to seat in apertures 76 in the bottom wall of the housing 22 (see FIG. 7).

As seen in FIG. 8, the land portions 72 are configured and designed with inwardly facing abutment surfaces 78- so that the garnets 58,60 and an appropriate portion of the center conductor 54 fit neatly therebetween. The long sides of the garnets 58,60 align with the inwardly facing abutment surfaces 78 of the land portions 72. As best seen in FIGS. 2 and 9, the first garnet 58 lies on the bottom wall of the housing 22 under the center conductor 54. The second garnet 60 is aligned with first garnet 58 above the center conductor 54.

The pole piece 64 is made of copper plated cold roll steel and is in a stack with the magnets 66 thereby creating a homogeneous magnetic field around the garnets 58, 60 and the sandwiched center conductor 54. The pole piece 64 and magnets 66 fit within the main annular body portion 68 of the centering ring 62 and seat on the land portions 72 and bridge portions 73 in intimate contact with the second garnet 60. With the cover 24 in place, the entire assembly is conveniently held together within the housing 22.

The isolator device 14 typically has the following electrical specifications:

| | |
|---|---|
| Frequency range | 800–900 MHz |
| Band width | 50 MHz |
| Isolation, min. | −53 dB |
| Power input, max. | 60 watts |
| Temperature range | −10 to +70° C. |
| VSWR max. (input/output) | 1.25:1 |
| Insertion loss | −.5 dB |
| Nominal Impedance | 50 ohms unbalanced. |

It should be appreciated by those skilled in the art that the present invention, although shown as being applied to a specific dual stage isolator device, can be utilized in single or triple stage devices depending on the amount of isolation required. It can also be applied equally well in circulator devices, which merely are isolator devices without the output stage isolated port load.

Thus, the present invention provides a unique centering ring capable of holding the garnet or garnets, center conductor, pole piece and magnets in position, centered with respect to one another, during and after assembly of the circulator/isolator device. The centering ring holds the garnets in place without undue pressure. The centering ring eliminates the need for adhesive or dielectric grease thereby greatly increasing performance of the device.

The preferred embodiment described above admirably achieves the objects of the invention; however, it will be appreciated that departures can be made by those skilled in the art without departing from the spirit and scope of the invention which is limited only by the following claims.

Having thus described the invention, what is claimed is:

1. A positioning device for centering a magnetic field source relative to at least one ferrite wafer and a center conductor in a device for directing radio frequencies, comprising:

a main body portion for retaining the magnetic field source; and means on said main body portion dimensionally sized to position the at least one ferrite wafer and a portion of the center conductor relative to the magnetic field source, said means to position includes land portions extending radially inwardly form one end of said main body portion, whereby the at least one ferrite wafer and the portion of the center conductor are positioned within a magnetic field of the magnetic field source.

2. A positioning device in accordance with claim 1, wherein said main body portion is dimensionally sized to receive the magnetic field source therewithin.

3. A positioning device in accordance with claim 2, wherein said main body portion is in the form of an annulus and the magnetic field source fits therewithin.

4. A positioning device in accordance with claim 3, wherein said land portions have inwardly facing abutment surfaces which align with sides of the at least one ferrite wafer to position the same relative to the magnetic field source.

5. A positioning device in accordance with claim 3, wherein said land portions are dimensionally sized to provide a seat for the magnetic field source.

6. A positioning device in accordance with claim 1, wherein said land portions have inwardly facing abutment surfaces which align with sides of the at least one ferrite wafer to position the same relative to the magnetic field source.

7. A positioning device in accordance with claim 1, wherein said land portions are dimensionally sized to provide a seat for the magnetic field source within said main body portion.

8. A device for directing radio frequencies comprising:

A. a housing forming n enclosure;

B. at least two radio frequency transmission lines extending into said enclosure of said housing;

C. a central conductor within said enclosure electrically connecting said liens with one another;

D. at least one ferrite wafer within said enclosure adjacent a portion of said central conductor;

E. a magnetic field source within said enclosure providing a magnetic field around said at least one ferrite wafer and said portion of said central conductor; and F. a positioning device for centering said magnetic field source relative to said at least one ferrite wafer and said center conductor, said positioning device including a main body portion for retaining said magnetic field source and means on said main body portion dimensionally sized to position said at least one ferrite wafer and said portion of said center conductor relative to said magnetic field source, said means to position includes land portions extending radially inwardly form one end of said main body portion, whereby said at least one ferrite wafer and said portion of said center conductor are positioned within the magnetic field of said magnetic field source.

9. A device for directing radio frequencies in accordance with claim 8, wherein said main body portion is dimensionally sized to receive said magnetic field source therewithin.

10. A device for directing radio frequencies in accordance with claim 9, wherein said main body portion is in the form of an annulus and said magnetic field source fits therewithin.

11. A device for directing radio frequencies in accordance with claim 10, wherein said land portions have inwardly facing abutment surfaces which align with sides of said at least one ferrite wafer to position the same relative to said magnetic field source.

12. A device for directing radio frequencies in accordance with claim 10, wherein said land portions are dimensionally sized to provide a seat for said magnetic field source within said main body portion.

13. A device for directing radio frequencies in accordance with claim 8, wherein said land portions have inwardly facing abutment surfaces which align with sides of said at least one ferrite wafer to position the same relative to said magnetic field source.

14. A device for directing radio frequencies in accordance with claim 13, wherein said at least one ferrite wafer is two ferrite wafer which sandwich said portion of said central conductor.

15. A device for directing radio frequencies in accordance with claim 14, wherein in said two ferrite wafers and said portion of said central conductor are positioned between said abutment surfaces of said land portions.

16. A device for directing radio frequencies in accordance with claim 15, wherein said magnetic field source abuts one of said ferrite wafers.

17. A device for directing radio frequencies in accordance with claim 8, wherein said land portions are dimensionally sized to provide a seat for said magnetic field source within the main body portion.

18. A device for directing radio frequencies in accordance with claim 17, wherein said magnetic field source abuts said at least one ferrite wafer.

19. A device for directing radio frequencies in accordance with claim 18, wherein said magnetic field source includes a magnet and a pole piece for providing a uniform magnetic field around said at least one ferrite wafer and said portion of said central conductor.

20. A device for directing radio frequencies in accordance with claim 19, wherein said pole piece abuts said at least one ferrite wafer.

21. A device for directing radio frequencies in accordance with claim 8, wherein said magnetic field source abuts said at least one ferrite wafer.

22. A device for directing radio frequencies in accordance with claim 21, wherein said magnetic field source includes a magnet and a pole piece for providing a uniform magnetic field around said at least one ferrite wafer and said portion of said central conductor.

23. A device for directing radio frequencies in accordance with claim 22, wherein said pole piece abuts said at least one ferrite water.

24. A device for directing radio frequencies in accordance with claim 8, wherein said main body portion of said positioning device is dimensionally sized to fit within said housing and prevent relative movement between said housing and said positioning device.

25. A device for directing radio frequencies in accordance with claim 24, wherein said main body portion has protrusions thereon which matingly engage said housing to prevent relative movement therebetween.

* * * * *